US008862027B2

(12) United States Patent
Fujii

(10) Patent No.: US 8,862,027 B2
(45) Date of Patent: Oct. 14, 2014

(54) DEVELOPING CARTRIDGE INCLUDING DEVELOPING GEAR COVER

(75) Inventor: Yasumasa Fujii, Anjo (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 824 days.

(21) Appl. No.: 13/052,932

(22) Filed: Mar. 21, 2011

(65) Prior Publication Data

US 2011/0236064 A1 Sep. 29, 2011

(30) Foreign Application Priority Data

Mar. 24, 2010 (JP) ..... 2010-068578

(51) Int. Cl.

| | |
|---|---|
| ***G03G 15/04*** | (2006.01) |
| ***G03G 21/18*** | (2006.01) |
| ***G03G 21/16*** | (2006.01) |
| *G03G 15/08* | (2006.01) |

(52) U.S. Cl.

CPC ..... *G03G 21/1821* (2013.01); *G03G 21/1817* (2013.01); *G03G 15/0896* (2013.01); *G03G 21/1676* (2013.01); *G03G 21/1814* (2013.01); *G03G 2221/163* (2013.01); *G03G 21/1647* (2013.01)

USPC ..... 399/119

(58) Field of Classification Search

CPC ..... G03G 21/1817; G03G 21/1821

USPC ..... 399/119

See application file for complete search history.

(56) References Cited

U.S. PATENT DOCUMENTS

| | | | | |
|---|---|---|---|---|
| 6,041,203 | A | 3/2000 | Suzuki et al. | |
| 6,330,410 | B1 | 12/2001 | Okabe et al. | |
| 6,349,189 | B1 * | 2/2002 | Jeon | 399/119 |
| 7,177,565 | B1 * | 2/2007 | Miller | 399/103 |

(Continued)

FOREIGN PATENT DOCUMENTS

| | | | |
|---|---|---|---|
| CN | 1815384 | A | 8/2006 |
| JP | H04-156484 | A | 5/1992 |

(Continued)

OTHER PUBLICATIONS

English machine translation of Japanese patent document Karakama et al. (JP 2005-326832 A); "Process Cartridge Remanufacturing Method"; published Nov. 24, 2005; Karakama, Toshiyuki; Komatsu, Noriyuki.*

(Continued)

*Primary Examiner* — David Gray
*Assistant Examiner* — Geoffrey Evans
(74) *Attorney, Agent, or Firm* — Merchant & Gould PC

(57) ABSTRACT

A developing cartridge includes: a housing having first and second sidewalls through which respective end portions of a developing roller shaft are rotatably inserted; a developing gear, which is arranged outside of the first sidewall, and which is fixed to the end portion of the developing roller shaft; a transmission gear, which is arranged outside of the first sidewall, and which transmits driving force to the developing gear; a first cover member, which is attached to the first sidewall, and which covers the transmission gear; and a second cover member, which is attached to the first sidewall, and which covers the developing gear from an outer side in the axis line direction. The second cover member is formed separately from the first cover member and is arranged side by side with the first cover member outside of the first sidewall.

14 Claims, 9 Drawing Sheets

(56) References Cited

U.S. PATENT DOCUMENTS

| | | | | |
|---|---|---|---|---|
| 7,366,441 | B2 * | 4/2008 | Hatori | 399/113 |
| 7,460,816 | B2 * | 12/2008 | Okabe | 399/222 |
| 7,613,414 | B2 * | 11/2009 | Kamimura | 399/90 |
| 7,620,347 | B2 * | 11/2009 | Okabe | 399/119 |
| 7,672,611 | B2 | 3/2010 | Nakaya | |
| 7,937,015 | B2 * | 5/2011 | Furuichi et al. | 399/94 |
| 8,311,449 | B2 * | 11/2012 | Kusudo et al. | 399/111 |
| 8,565,650 | B2 * | 10/2013 | Sato | 399/258 |
| 8,600,267 | B2 * | 12/2013 | Sato | 399/254 |
| 8,682,216 | B2 * | 3/2014 | Handa et al. | 399/119 |
| 8,688,010 | B2 * | 4/2014 | Kato | 399/222 |
| 2002/0028087 | A1 | 3/2002 | Higeta et al. | |
| 2005/0232654 | A1 | 10/2005 | Karakama et al. | |
| 2006/0029418 | A1 | 2/2006 | Ishii et al. | |
| 2006/0029419 | A1 | 2/2006 | Shiraki | |
| 2006/0029420 | A1 | 2/2006 | Ishii et al. | |
| 2006/0029421 | A1 | 2/2006 | Ishii et al. | |
| 2006/0029422 | A1 | 2/2006 | Shiraki | |
| 2006/0029423 | A1 | 2/2006 | Shiraki | |
| 2006/0171739 | A1 | 8/2006 | Nakaya | |
| 2006/0193643 | A1 * | 8/2006 | Takagi et al. | 399/12 |
| 2007/0140725 | A1 * | 6/2007 | Kamimura | 399/90 |
| 2007/0237549 | A1 * | 10/2007 | Okabe | 399/222 |
| 2008/0044200 | A1 | 2/2008 | Okamoto | |
| 2008/0187356 | A1 * | 8/2008 | Tsui et al. | 399/111 |
| 2008/0205928 | A1 * | 8/2008 | Ishikawa | 399/111 |
| 2008/0205931 | A1 * | 8/2008 | Ishikawa | 399/119 |
| 2009/0297208 | A1 * | 12/2009 | Suzuki et al. | 399/109 |
| 2011/0236063 | A1 * | 9/2011 | Handa et al. | 399/119 |
| 2014/0099145 | A1 * | 4/2014 | Nakajima et al. | 399/113 |
| 2014/0105636 | A1 * | 4/2014 | Okabe, Yasushi | 399/110 |

FOREIGN PATENT DOCUMENTS

| | | | |
|---|---|---|---|
| JP | 2000-267371 | A | 9/2000 |
| JP | 2001-125469 | A | 5/2001 |
| JP | 2002-014593 | A | 1/2002 |
| JP | 2005-326832 | A | 11/2005 |
| JP | 2006-065099 | A | 3/2006 |
| JP | 2006-184501 | A | 7/2006 |
| JP | 2006-208941 | A | 8/2006 |

OTHER PUBLICATIONS

The State Intellectual Property Office of the People's Republic of China, Notification of First Office Action for Chinese Patent Application No. 201110075920.6 (counterpart Chinese patent application), issued Aug. 2, 2012.

Japan Patent Office, Notification of Reason for Refusal for Japanese Patent Application No. 2010-068578 (counterpart to above-captioned patent application), dispatched Mar. 21, 2012.

* cited by examiner

DEVELOPING CARTRIDGE INCLUDING DEVELOPING GEAR COVER

CROSS-REFERENCE TO RELATED APPLICATIONS

This application claims priority from Japanese Patent Application No. 2010-068578 filed on Mar. 24, 2010, the entire subject matter of which is incorporated herein by reference.

TECHNICAL FIELD

The present invention relates to a developing cartridge that is provided to an image forming apparatus such as laser printers.

BACKGROUND ART

In an image forming apparatus such as laser printers, there has been proposed a developing cartridge that is detachably mounted in a main body of the apparatus.

The developing cartridge has a box-shaped housing, for example. Toner is accommodated in the housing. A rectangular opening is formed on one side of the housing. A developing roller is rotatably supported by a first sidewall and a second sidewall, which face each other with the opening of the housing interposed therebetween. In other words, the developing roller has a developing roller shaft that extends in a longitudinal direction of the opening. Both end portions of the developing roller shaft are rotatably inserted in the first and second sidewalls, respectively, so that the developing roller is provided to be rotatable about the developing roller shaft. Outside the first sidewall, a developing gear is fixed to one end portion of the developing roller shaft at the first sidewall. When driving force is transmitted to the developing gear, the developing roller (developing roller shaft) is integrally rotated with the developing gear.

A gear cover is attached to an outer side face of the first sidewall. The developing gear and a plurality of gears, which form a gear train for transmitting the driving force to the developing gear, are collectively covered by the gear cover.

SUMMARY

In recent years, it is required to reuse the developing cartridge.

The developing roller deteriorates as the developing cartridge is used. Accordingly, when reusing the developing cartridge, it is often necessary not only to supplement toner and but also to replace the developing roller.

In order to replace the developing roller, the gear cover should be separated from the housing. When the gear cover is separated, all gears including the developing gear are exposed. Accordingly, a user should replace the developing roller while paying special attention to dropping of the gears from the housing, so that it takes much time to perform the replacement operation.

Therefore, illustrative aspects of the invention provide a developing cartridge capable of reducing a troublesome operation of attaching and detaching a developing roller to and from a housing.

According to one aspect of the invention, there is provided a developing cartridge comprising: a developing roller having a developing roller shaft; a housing comprising a first sidewall through which a first end portion of the developing roller shaft is rotatably inserted along an axis line direction thereof and a second sidewall through which a second end portion of the developing roller shaft is rotatably inserted along an axis line direction thereof; a developing gear, which is arranged outside of the first sidewall, and which is fixed to the first end portion of the developing roller shaft at the first sidewall; a transmission gear, which is arranged outside of the first sidewall, and which transmits driving force to the developing gear; a first cover member, which is attached to the first sidewall, and which covers the transmission gear from an outer side in the axis line direction; and a second cover member, which is attached to the first sidewall, and which covers the developing gear from the outer side in the axis line direction and through which the first end portion of the developing roller shaft is inserted with an interval formed between the second cover member and the first end portion, wherein the second cover member is formed separately from the first cover member and is arranged side by side with the first cover member outside of the first sidewall.

According to the aspects of the invention, both end portions of the developing roller shaft of the developing roller are rotatably inserted into the first and second sidewalls of the housing, respectively. The developing gear is fixed to the developing roller shaft at the outside of the first sidewall. In addition, the transmission gear that transmits driving force to the developing gear is arranged at the outside of the first sidewall. The first cover member and the second cover member are attached to the first sidewall side by side. The transmission gear and the developing gear are individually covered in the axis line direction by the first cover member and the second cover member, respectively. The end portion of the developing roller shaft at the first sidewall is inserted into the second cover member at a predetermined interval.

Since the developing roller shaft is rotated during the developing, the second cover member is necessarily provided so as to prevent the end portion of the developing roller shaft from contacting another member. However, according to the above configuration, when attaching and detaching the developing roller to and from the housing, the second cover member is separated and the first cover member is not necessarily separated. Accordingly, when attaching and detaching the developing roller to and from the housing, a user can perform the attaching and detaching operation freely and easily because it is not necessary to pay attention to the detachment of the transmission gear. As a result, it is possible to reduce the troublesome operation of attaching and detaching the developing roller to and from the housing.

DETAILED DESCRIPTION

Hereinafter, exemplary embodiments of the invention will be specifically described with reference to the drawings.

(Printer)

Figure 1:
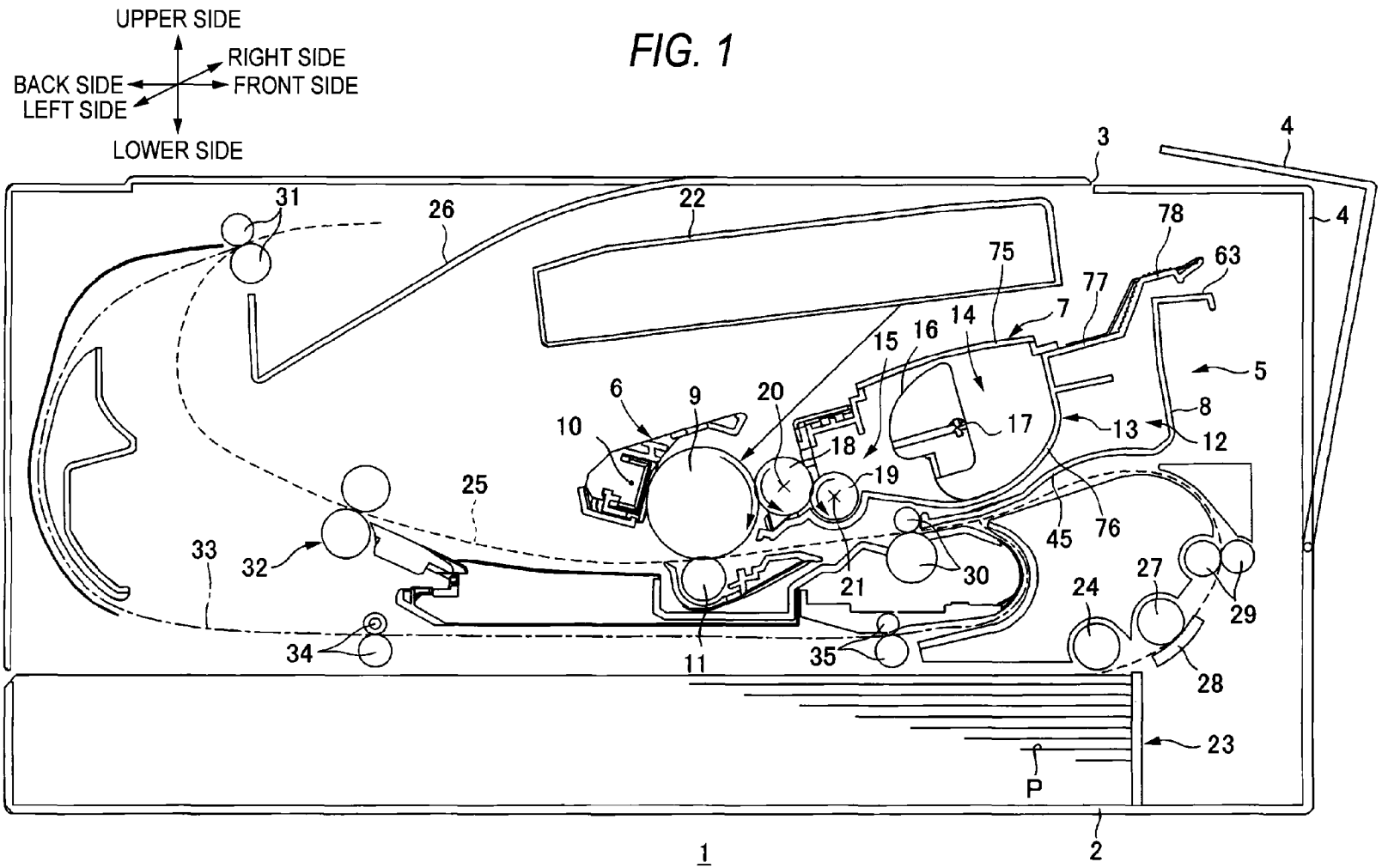
FIG. 1 is a sectional view of a laser printer to which a process cartridge according to an illustrative embodiment of the invention is mounted.

As shown in FIG. 1, a laser printer 1 (one example of an image forming apparatus) has a body casing 2 (one example of a main body). One sidewall of the body casing 2 is formed with a cartridge attaching and detaching port 3 and is provided with a front cover 4 that opens and closes the cartridge attaching and detaching port 3.

In the following descriptions, a side at which the front cover 4 is provided is referred to as a front side. The upper, lower, left and right of the laser printer 1 are set when seen from the front side of the laser printer 1. In addition, regarding a developing cartridge 7 (which will be described later), the front and back are set based on a state in which the developing cartridge is mounted to the body casing 2. Further, the upper, lower, left and right of the developing cartridge 7 are set when seen from the front side of the developing cartridge 7.

A process cartridge 5 is mounted at a slightly more forward position than a center in the body casing 2. The process cartridge 5 is mounted into the body casing 2 and detached from the body casing through the cartridge attaching and detaching port 3 when the front cover 4 is opened.

The process cartridge 5 includes a drum cartridge 6 and a developing cartridge 7. The developing cartridge 7 is detachably mounted to the drum cartridge 6.

The drum cartridge 6 has a drum frame 8. A photosensitive drum 9 is rotatably held at a rear end portion of the drum frame 8. In addition, the drum frame 8 holds a charger 10 and a transfer roller 11. The charger 10 and the transfer roller 11 are arranged at front and lower sides of the photosensitive drum 9, respectively.

A more forward part of the drum frame 8 than the photosensitive drum 9 is a developing cartridge mounting part 12. The developing cartridge 7 is mounted to the developing cartridge mounting part 12.

The developing cartridge 7 has a housing 13 that accommodates toner. In the housing 13, a toner accommodating chamber 14 and a developing chamber 15, which communicate with each other, are formed to be adjacent forward and backward.

The toner accommodating chamber 14 is provided therein with an agitator 16 so that the agitator 16 can be rotated about an agitator rotational shaft 17. The agitator rotational shaft 17 extends leftward and rightward. When the agitator 16 is rotated, the toner accommodated in the toner accommodating chamber 14 is supplied to the developing chamber 15 from the toner accommodating chamber 14 while being stirred.

The developing chamber 15 is provided therein with a developing roller 18 and a supply roller 19 so that the developing roller 18 and the supply roller 19 can be rotated about a developing rotational axis line 20 and a supply rotational axis line 21 extending leftward and rightward, respectively. The developing roller 18 is arranged so that a part of a circumferential surface thereof is exposed from a rear end portion of the housing 13. The developing cartridge 7 is mounted to the drum cartridge 31 so that the circumferential surface of the developing roller 18 contacts a circumferential surface of the photosensitive drum 9. The supply roller 19 is arranged so that a circumferential surface thereof contacts the circumferential surface of the developing roller 18 from a front-lower side. The toner in the developing chamber 15 is supplied to the circumferential surface of the developing roller 18 by the supply roller 19 and is carried as a thin layer on the circumferential surface of the developing roller 18.

In the body casing 2, an exposure device 22 that emits a laser and the like is arranged above the process cartridge 5.

When forming an image, the photosensitive drum 9 is rotated at a constant speed in a clockwise direction of FIG. 1. As the photosensitive drum 9 is rotated, the circumferential surface of the photosensitive drum 9 is uniformly charged by discharge from the charger 10. In the meantime, based on image data received from a personal computer (not shown) connected to the printer 1, the laser beam is emitted from the exposure device 22. The laser beam passes between the charger 10 and the developing cartridge 7 and irradiates the circumferential surface of the photosensitive drum 9 that is positively charged, thereby selectively exposing the circumferential surface of the photosensitive drum 9. Thus, charges are selectively removed from the exposed part of the photosensitive drum 9, so that an electrostatic latent image is formed on the circumferential surface of the photosensitive drum 9. When the electrostatic latent image faces the developing roller 18 as the photosensitive drum 9 is rotated, the toner is supplied to the electrostatic latent image from the developing roller 18. Thereby, a toner image is formed on the circumferential surface of the photosensitive drum 9.

A sheet feeding tray 23 that stacks sheets P therein is arranged on a bottom part of the body casing 2. A pickup roller 24 for sending the sheets from the sheet feeding tray 23 is provided above the sheet feeding tray 23.

Additionally, a conveyance path 25, which has an S shape when seen from the side face, is formed in the body casing 2. The conveyance path 25 reaches a sheet discharge tray 26 formed at an upper surface of the body casing 2 via a space between the photosensitive drum 9 and the transfer roller 11 from the sheet feeding tray 23. A separation roller 27 and a separation pad 28, which are arranged to be opposite to each other, a pair of feeder rollers 29, a pair of register rollers 30 and a pair of sheet discharge rollers 31 are provided on the conveyance path 25.

The sheets P sent from the sheet feeding tray 23 are separated one at a time while passing between the separation roller 27 and the separation pad 28. Then, the sheet P is conveyed toward the register rollers 30 by the feeder rollers 29. Then, the sheet P is registered by the register rollers 30 and then conveyed between the photosensitive drum 9 and the transfer roller 11 by the register rollers 30.

The toner image on the circumferential surface of the photosensitive drum 9 is electrically attracted and transferred on the sheet P by the transfer roller 11 when the toner image faces the sheet P passing between the photosensitive drum 9 and the transfer roller 11 by the rotation of the photosensitive drum 9.

On the conveyance path 25, a fixing device 32 is provided at a downstream side of the conveyance direction of the sheet P regarding the transfer roller 11. The sheet P, on which the toner image is transferred, is conveyed through the conveyance path 25 and passes through the fixing device 32. In the fixing device 32, the toner image becomes an image that is then fixed on the sheet P by heating and pressing.

The printer 1 has a one-sided mode of forming an image (toner image) on one side of the sheet P and a duplex mode of forming an image on one side of the sheet P and then forming an image on the other side of the sheet P, as operation modes.

In the one-sided mode, the sheet P having an image formed on one side thereof is discharged to the sheet discharge tray 26 by the sheet discharge rollers 31.

As a configuration for realizing the duplex mode, the body casing 2 includes a reverse conveyance path 33. The reverse conveyance path 33 extends between the conveyance path 25 and the sheet feeding tray 23 from the vicinity of the sheet discharge rollers 31 and is connected to a part between the feeder rollers 29 and the register rollers 30 on the conveyance path 25. A pair of first reverse conveyance rollers 34 and a pair of second reverse conveyance rollers 25 are provided on the reverse conveyance path 33.

In the duplex mode, the sheet P having an image formed on one side thereof is sent to the reverse conveyance path 33 without being discharged to the sheet discharge tray 26. Then, the sheet P is conveyed through the reverse conveyance path 33 by the first reverse conveyance rollers 34 and the second reverse conveyance rollers 35 and two sides of the sheet are reversed, so that the other side having no image formed thereon is sent to the conveyance path 25 while facing the circumferential surface of the photosensitive drum 9. Then, an image is formed on the other side of the sheet P, so that the images are formed on both sides of the sheet P.

(Process Cartridge)

(1) Drum Cartridge (1-1) Drum Frame

Figure 2:
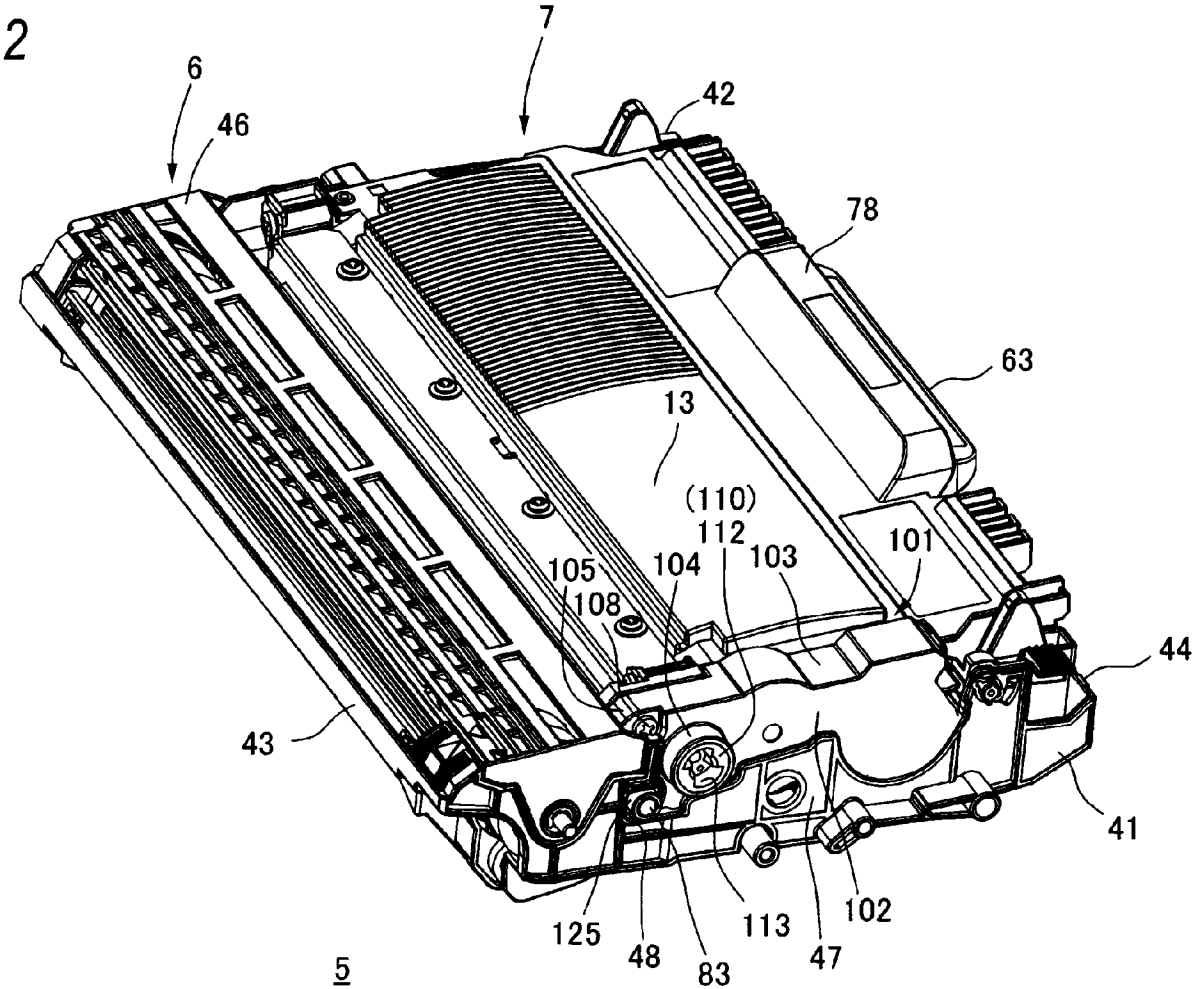
FIG. 2 is a perspective view of a process cartridge shown in FIG. 1, which is seen from a left, back and upper direction.

As shown in FIG. 2, the drum frame 8 of the drum cartridge 6 has a left sidewall 41 and a right sidewall 42. The left sidewall 41 and the right sidewall 42 have an elongated plate shape extending in the front-rear direction and face each other at an interval in the left-right direction. A back side wall 43 is bridged between respective rear end portions of the left sidewall 41 and the right sidewall 42. A front side wall 44 is bridged between respective front end portions of the left sidewall 41 and the right sidewall 42. As shown in FIG. 1, a bottom wall 45 is bridged between respective lower end portions of the left sidewall 41 and the right sidewall 42 so as to block the lower part thereof. Thereby, the drum frame 8 has a quadrangular frame shape having a closed bottom when seen from a plan view.

As shown in FIG. 2, an upper side wall 46 is bridged between the respective rear end portions of the left sidewall 41 and the right sidewall 42 so as to cover the upper side wall from above. The photosensitive drum 9 and the transfer roller 11 are rotatably supported by the left sidewall 41 and the right sidewall 42 between the upper side wall 46 and the bottom wall 43. In addition, the charger 10 (refer to FIG. 1) is provided between the respective rear end portions of the left sidewall 41 and the right sidewall 42 to block a space between the rear side wall 43 and the upper side wall 46 at the rear part of the upper side wall 46.

In the space sandwiched between the left sidewall 41 and the right sidewall 42, a part that is not opposed to the upper side wall 46 and has an opened upper portion becomes the developing cartridge mounting part 12. When the developing cartridge 7 is mounted to the developing cartridge mounting part 12, parts (hereinafter, referred to as 'developing cartridge facing parts') 47 of the left sidewall 41 and the right sidewall 42, which face the developing cartridge mounting part 12, are arranged to face the developing cartridge 7 at a slight interval, respectively. In addition, an upper face of the upper side wall 46 is substantially flush with an upper face of the developing cartridge 7.

A back side upper end portion of each developing cartridge facing part 47 is formed with a roller shaft receiving part 48 (one example of a guidance part) having a substantially C shape having an opened front side.

(1-2) Drum Side Holding Part

As shown in FIG. 2, a central part of the left-right direction of the front side wall 44 of the drum frame 8 is provided with a drum side holding part 63. The drum side holding part 63 has a rectangular shape. The drum side holding part 63 is elongated in the left-right direction when seen from a plan view and is integrally formed with the front side wall 44.

(2) Developing Cartridge (2-1) Housing

Figure 3:
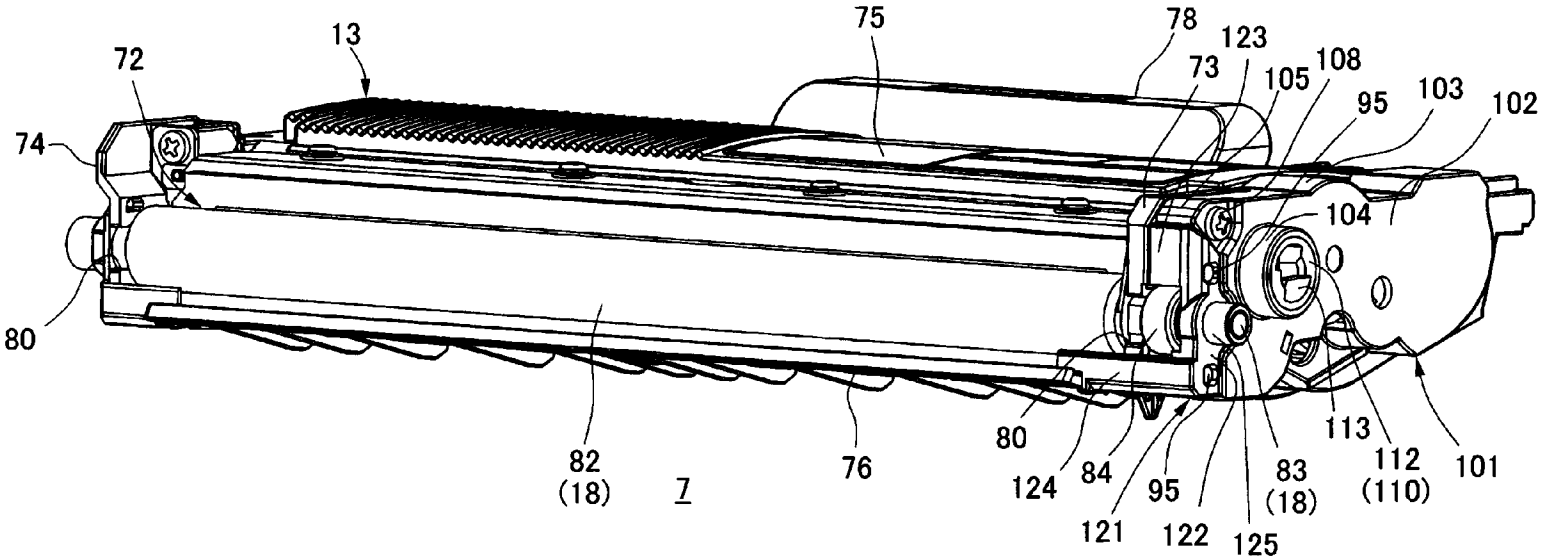
FIG. 3 is a perspective view of a developing cartridge shown in FIG. 2, which is seen from a left-back side.

As shown in FIG. 3, the housing 13 of the developing cartridge 7 has a box shape. The housing 13 is formed with an opening 72 that is opened rearward.

Specifically, the housing 13 has a left sidewall 73 (one example of a first sidewall) and a right sidewall 74 (one example of a second sidewall). The left sidewall 73 and the right sidewall 74 face each other in the left-right direction and have a plate shape that extends in the front-rear direction, respectively. In addition, the housing 13 has an upper side wall 75 that is bridged between respective upper end portions of the left sidewall 73 and the right sidewall 74 and a lower side wall 76 that is bridged between respective lower end portions of the left sidewall 73 and the right sidewall 74. As shown in FIG. 1, a front end portion of the lower side wall 76 extends upwardly with being curved and is bonded to a front end portion of the upper side wall 75.

Figure 5:
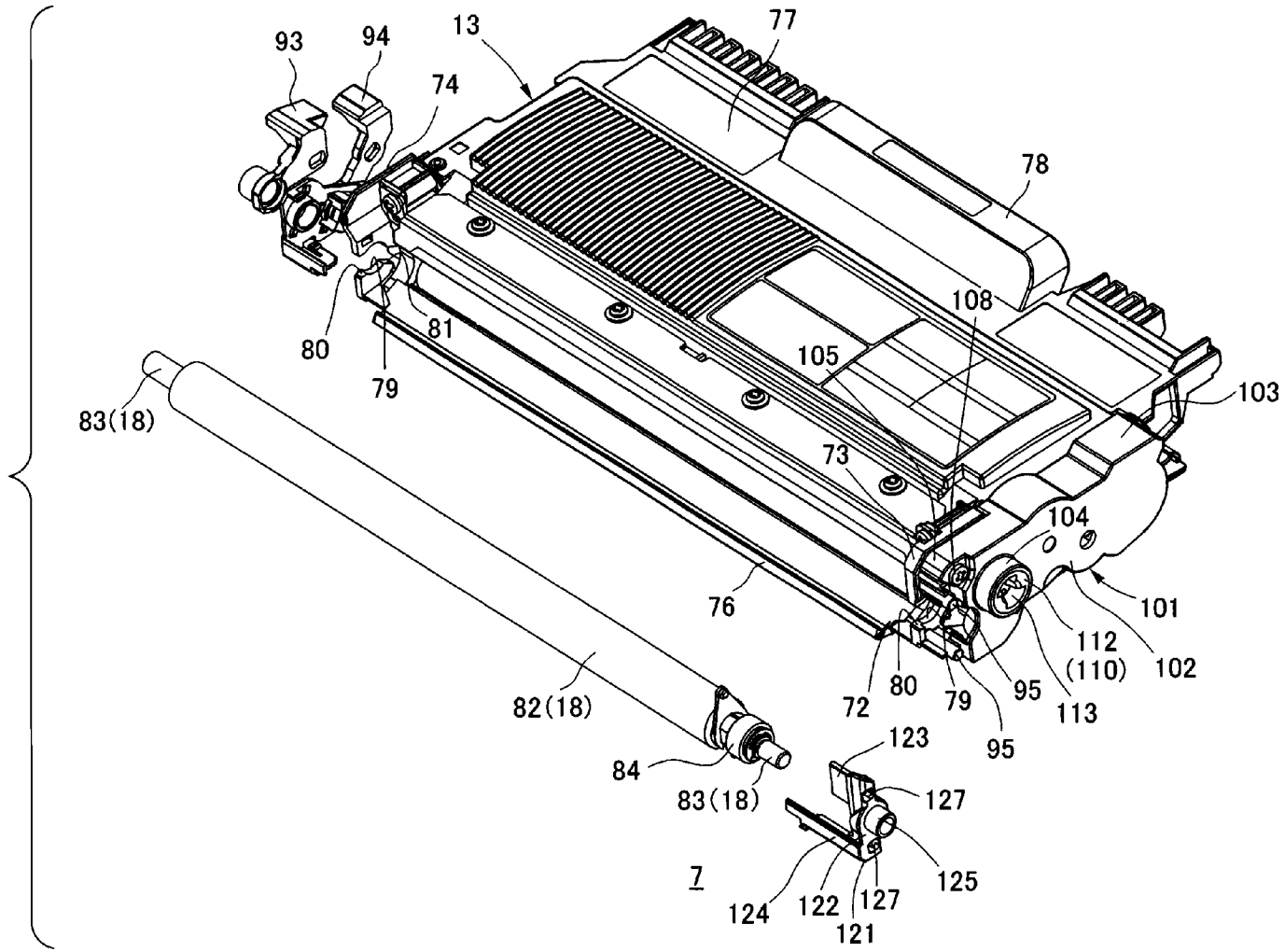
FIG. 5 is an exploded perspective view showing respective members of the developing cartridge shown in FIG. 2.

In addition, as shown in FIGS. 1, 2 and 5, the front end portion of the lower side wall 76 has an extension 77 that extends more forwardly from the portion bonded with the front end portion of the upper side wall 75. The extension 77 is formed at its central part of the left-right direction thereof with a developing side holding part 78. The developing side holding part 78 protrudes into a rectangular shape elongated in the left-right direction when seen from a plan view and has a substantially C shape having an opened lower side when seen from a front side.

As shown in FIG. 5, the respective rear end portions of the left sidewall 73 and the right sidewall 74 are formed at positions facing each other in the left-right direction with first shaft insertion through-holes 79 having a circular shape when seen from a side face, respectively. In addition, the left sidewall 73 and the right sidewall 74 are formed at rear positions of the first shaft insertion through-holes 79 with first penetrated shaft introducing parts 80 communicating with the first shaft insertion through-holes 79 and having a rectangular shape when seen from a side face. The first shaft introducing parts 80 are opened at respective rear end edges of the left sidewall 73 and the right sidewall 74. In addition, although not shown, the left sidewall 73 and the right sidewall 74 are formed at front-lower sides of the first shaft insertion through-holes 79 with second shaft insertion through-holes through which the shaft of the supply roller 19 is inserted. Also, the left sidewall 73 and the right sidewall 74 are formed with second penetrated shaft introducing parts 81 that communicate with the first shaft insertion through-holes 79 with the second shaft insertion through-holes.

In addition, the left sidewall 73 is formed with thin cylindrical bosses 95, which protrude leftward, above and below the first shaft introducing part 80.

(2-2) Developing Roller

Figure 4:
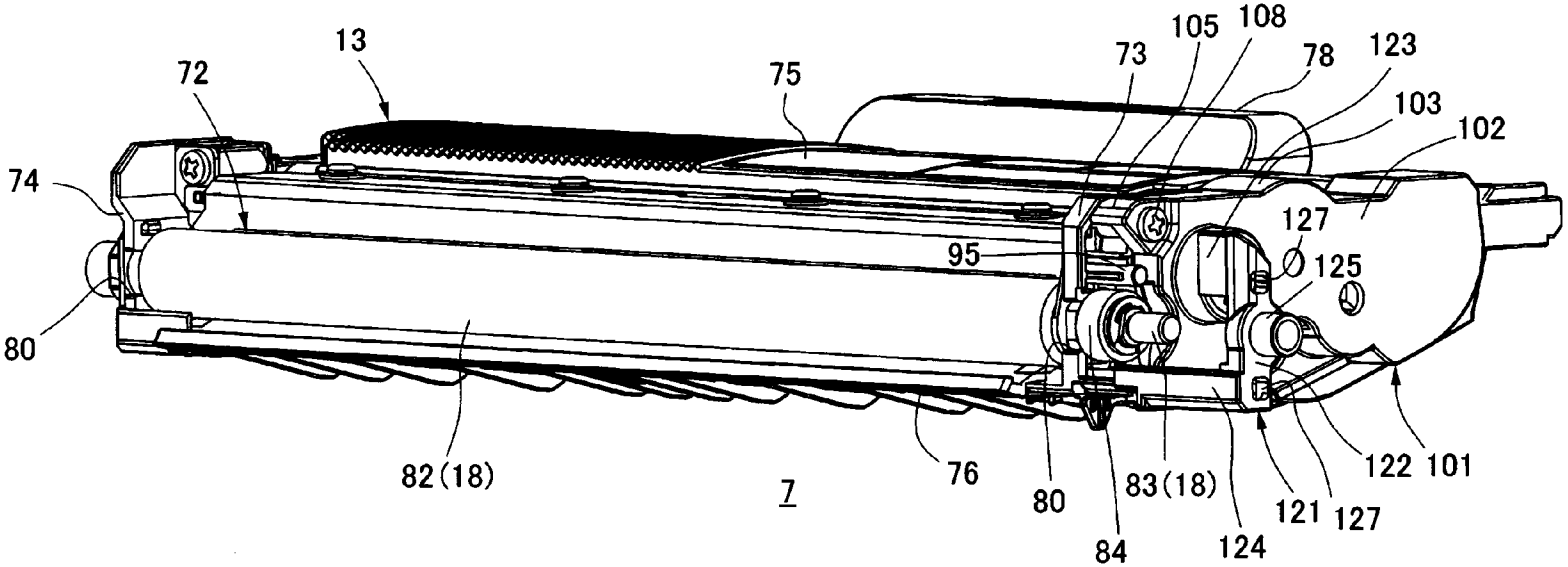
FIG. 4 is a perspective view of the developing cartridge shown in FIG. 2, which is seen from a left-back side, in which a second gear cover is separated.

The developing roller 18 has a cylindrical roller main body 82 having an axis line extending in the left-right direction as a center and a developing roller shaft 83 that is inserted into the roller main body 82 along the central axis line thereof. Both left and right end portions of the developing roller shaft 83 protrude from both left and right end faces of the roller main body 82, respectively. As shown in FIG. 4, the left end portion of the developing roller shaft 83 is rotatably inserted into the first shaft insertion through-hole 79 of the left sidewall 73 and protrudes outwardly from the left sidewall 73. In addition, the right end portion of the developing roller shaft 83 is rotatably inserted into the first shaft insertion through-hole 79 of the right sidewall 74 and protrudes outwardly from the right sidewall 74.

Incidentally, the left and right end portions of the developing roller shaft 83 can be arranged in the first shaft insertion through-holes 79 and separated from the first shaft insertion through-holes 79 through the first shaft introducing parts 80.

(2-3) Developing Roller Shaft

Figure 9:
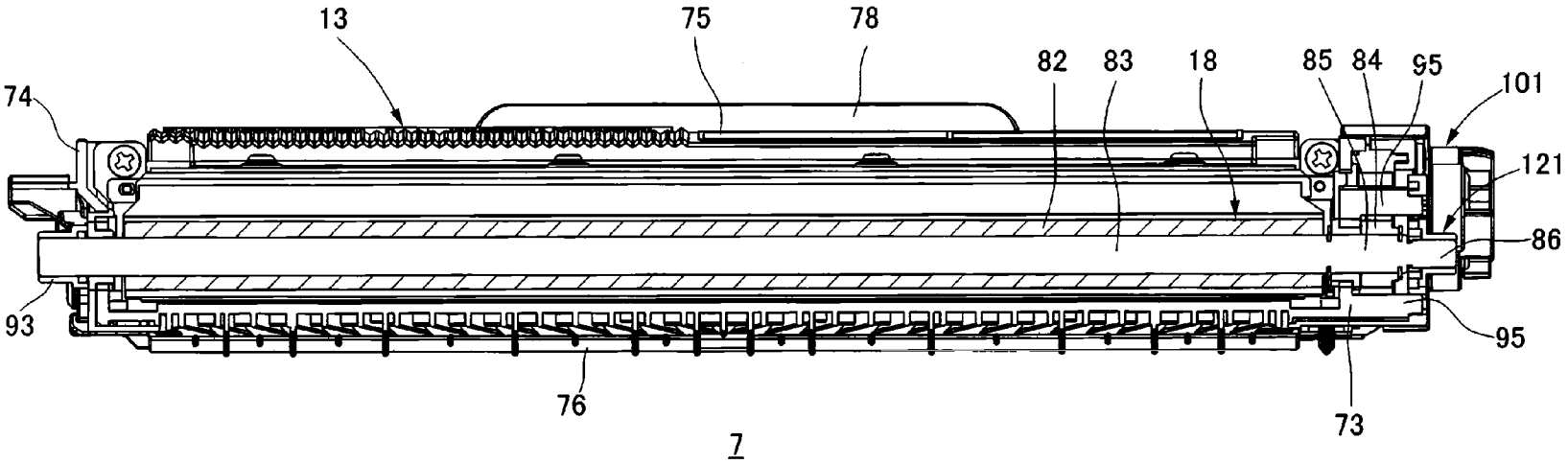
FIG. 9 is a sectional view of the developing cartridge taken along a line IX-IX shown in FIG. 8.
Figure 10:
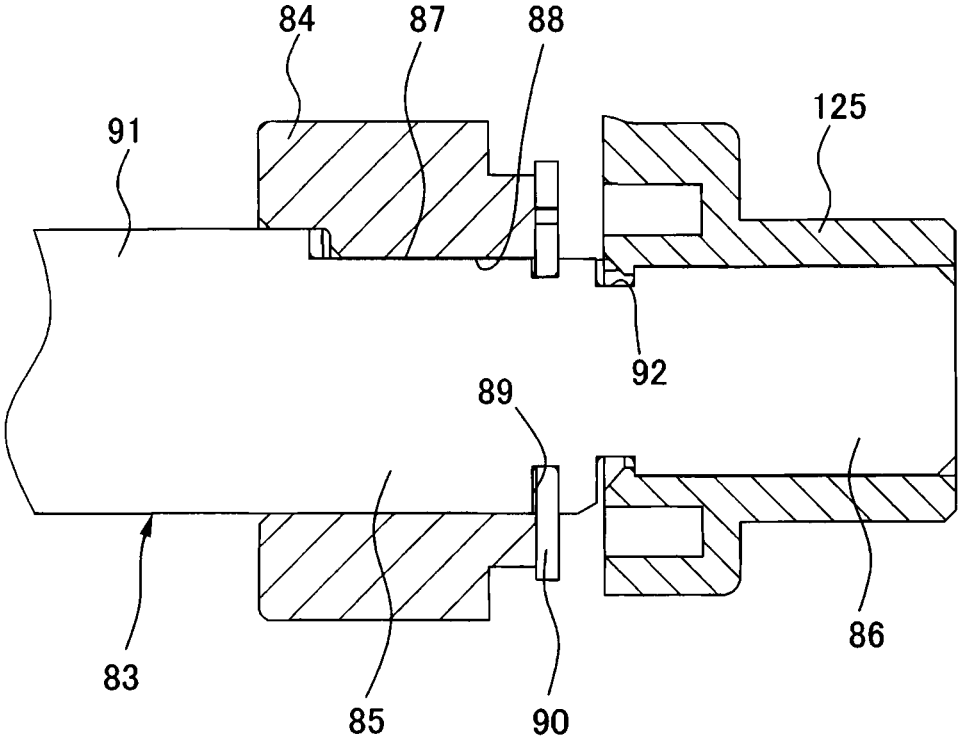
FIG. 10 is an enlarged sectional view of a left end portion of a developing gear.

As shown in FIGS. 9 and 10, the left end portion of the developing roller shaft 83 has at its outwardly protruding part from the left sidewall 73 a gear fixing part 85 to which a developing gear 84 is fixed and a small diameter part 86 that is formed at a left side of the gear fixing part 85 and becomes a leftmost end portion of the developing roller shaft 83.

As shown in FIG. 10, the gear fixing part 85 is processed into a D sectional shape having a planar surface 87 on a part of a circumferential surface thereof. The gear fixing part is one example of a D-cut part. The developing gear 84 has a D-shaped hole 88 corresponding to the shape of the gear fixing part 85, which is penetrated along a central axis line thereof. As the gear fixing part 85 is inserted into the D-shaped hole 88, the developing gear 84 is attached to the developing roller shaft 83 so that the developing gear cannot be relatively rotated. In addition, the gear fixing part 85 is formed at a left side of the planar surface 87 with a gear fixing recess 89 over a circumferentially overall region thereof. A separation preventing member 90 is fixed to a left end face of the developing gear 84. As the separation preventing member 90 is fitted in the gear fixing recess 89, the developing gear 84 is attached to the developing roller shaft 83 so that the developing gear cannot be relatively moved in the left-right direction.

The small diameter part 86 has a cylindrical shape whose diameter is smaller than a right side part 91 of the gear fixing part 85 of the developing roller shaft 83.

In addition, the developing roller shaft 83 is formed with a cover fixing recess 92 over its circumferentially overall region between the gear fixing part 85 and the small diameter part 86.

As shown in FIGS. 5 and 9, the right end portion of the developing roller shaft 83 is attached with a developing electrode 93 for applying developing bias to the developing roller 18 at the right side of the right sidewall 74.

In addition, the supply roller 19 has a supply roller shaft (not shown) that extends along a central axis line thereof. A right end portion of the supply roller shaft is attached with a supply electrode 94 for applying supply bias to the supply roller 19 at the right side of the right sidewall 74.

(2-4) First Gear Cover

A first gear cover 101 (one example of the first cover member) is provided at the outside of the left sidewall 73 of the housing 13.

Figure 8:
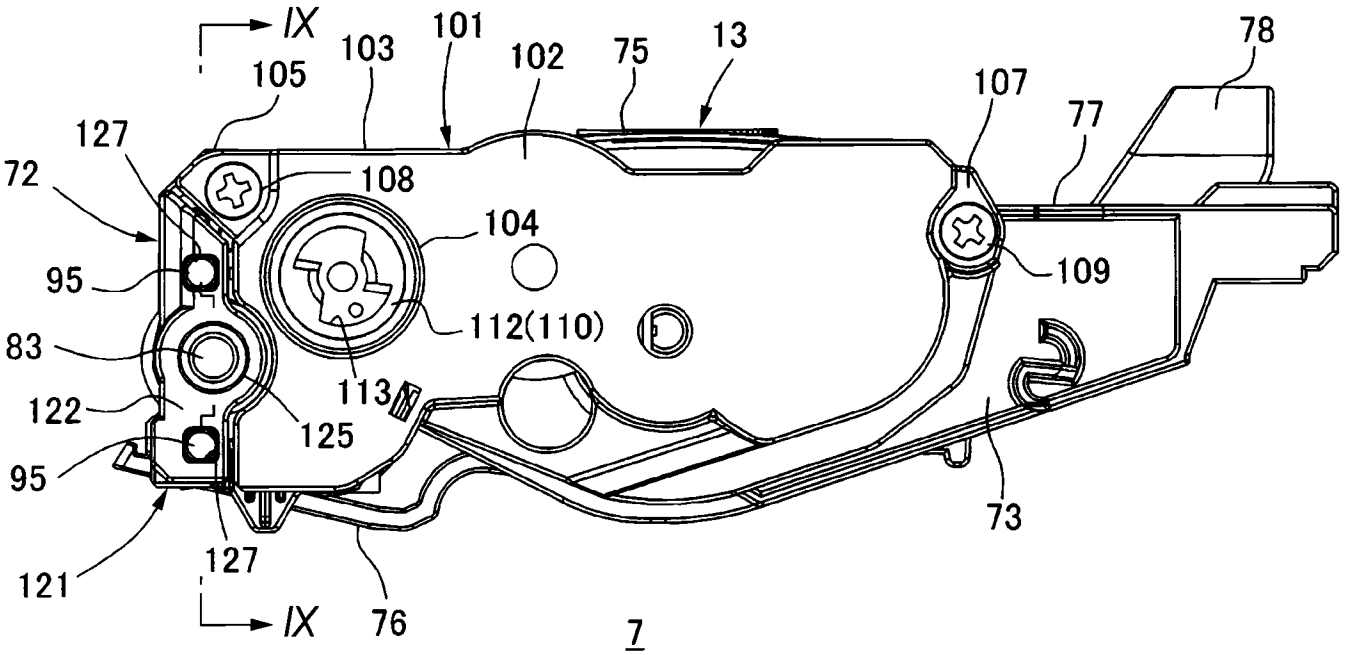
FIG. 8 is a left side view of the developing cartridge shown in FIG. 2.

As shown in FIG. 8, the first gear cover 101 has integrally a main body part 102 that extends forward and backward along the left sidewall 73 and a peripheral wall part 103 that extends to the left sidewall 74 from upper, front and lower end edges of the main body part 102.

The main body part 102 is formed at its rear end portion with a back side screw insertion penetration part 105 (one example of the contact part) that is one-step dented at the right side.

The main body part 102 is formed at is front end portion with a front side screw insertion penetration part 107 that is one-step dented at the right side.

The first gear cover 101 is attached to the left sidewall 73 by screws 108, 109 that are respectively inserted into the back side screw insertion penetration part 105 and the front side screw insertion penetration part 107.

(2-5) Gear Train

A gear train including an input gear 110 (one example of a transmission gear) is arranged between the left sidewall 73 and the first gear cover 101.

The input gear 110 has a coupling part 112 that is received in the coupling receiving part 104 of the first gear cover 101. A left side end face of the coupling part 112 is formed with a connection recess portion 113. Under state in which the developing cartridge 7 (process cartridge 5) is mounted in the body casing 2 (refer to FIG. 2), a driving output member (not shown) provided in the body casing 2 is inserted in the connection recess portion 113. Driving force for rotating the developing roller 18 and the like is input to the input gear 110 from the driving output member. In addition, although not shown, the input gear 110 has a gear part having gear teeth formed on a circumferential surface thereof in the first gear cover 101. The gear teeth of the gear part are engaged with the developing gear 84. Thereby, when the driving force is input to the input gear 110, the driving force is transmitted from the input gear 110 to the developing gear 84, so that the developing roller 18 is rotated together with the developing gear 84.

(2-6) Second Gear Cover

At the outside of the left sidewall 73 of the housing 13, a second gear cover 121 (one example of the second cover member) is arranged side by side with the first gear cover 101 at a back side of the first gear cover 101 and at a lower side of the back side screw insertion penetration part 105.

Figure 6:
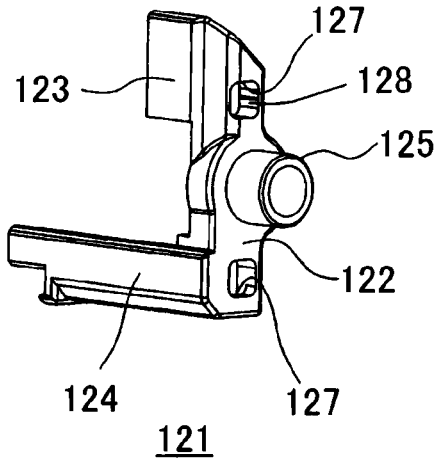
FIG. 6 is a perspective view of a second gear cover.
Figure 7:
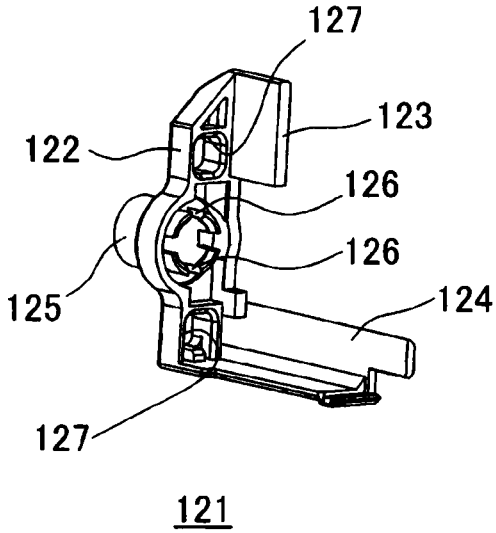
FIG. 7 is a perspective view of the second gear cover, when seen from an opposite side to FIG. 6.

As shown in FIGS. 6 and 7, the second gear cover 121 integrally includes a main body part 122, an upper extension 123 and a toner accommodating part 124 (one example of a developer accommodating part). The main body part 122 having a substantially rectangular shape is vertically long when seen from the side face. The upper extension 123 having a rectangular plate shape extends rightward from an upper part of a rear end edge of the main body part 122. The toner accommodating part 124 having an L-shaped section extends rightward from a lower part of the rear end edge of the main body part 122 and a lower end edge thereof.

A corner part configured by the main body part 122 and the upper extension 123 is chamfered so as to remove a corner. In addition, a corner part configured by the main body part 122 and the toner accommodating part 124 is also chamfered so as to remove a corner.

A longitudinally central portion of the main body part 122 is formed with a cylindrical shaft insertion part 125 that protrudes leftward. A hollow portion of the shaft insertion part 125 communicates the inside and outside of the main body part 122. An inner surface of the shaft insertion part 125 is formed with a plurality of protruding engagement claws 126 (one example of an engagement part) having a triangular section.

In addition, the main body part 122 is formed with boss insertion holes 127 having a substantially square shape above and below the shaft insertion part 125. The boss insertion holes 127 pass through the main body part 122. An opening area of the boss insertion hole 127 is larger than a sectional area of the boss 95. A relative position relation between the upper boss insertion hole 127 and the shaft insertion part 125 is substantially the same as a relative position relation between the first shaft insertion through-hole 79 and the upper boss 95. In addition, a relative position relation between the lower boss insertion hole 127 and the shaft insertion part 125 is substantially the same as the relative position relation between the first shaft insertion through-hole 79 and the upper boss 95. Additionally, the upper boss insertion hole 127 is formed at a front side of an inner surface thereof with a ridge-type projection 128 that protrudes backward and extends leftward and rightward. In order to prevent frictional force due to rotation when inserting the developing roller shaft 83 into the shaft insertion part 125, a predetermined interval is formed between the developing roller shaft 83 and the shaft insertion part 125.

The small diameter part 86 of the developing roller shaft 83 inserted into the first shaft insertion through-holes 79 is inserted into the shaft insertion part 125 and the bosses 95 protruding from the left sidewall 73 of the housing 13 are inserted into the respective boss insertion holes 126, so that the second gear cover 121 is attached to the left sidewall 73 at a state that the second gear cover is positioned in a rotational direction having the developing roller shaft 83 as a center. The engagement claws 126 of the shaft insertion part 125 enter the cover fixing recess 92 of the developing roller shaft 83, so that the second gear cover 121 is attached to the left sidewall 73 at a state in which the second gear cover is positioned in the left-right direction conforming to the developing roller shaft 83.

At the state in which the second gear cover 121 is attached to the left sidewall 73, the main body part 122 is opposed to the developing gear 84 from the left side and covers the developing gear 84 from the left side. In addition, the toner accommodating part 124 is opposed to the left lower end portion of the opening 72 of the housing 13 from the back side. Furthermore, a head of the screw 108 inserted into the back side screw insertion penetration part 105 is arranged at the right side of the outer surface of the main body part 122.

(3) Attachment and Detachment of Developing Cartridge to and from Drum Cartridge When the developing cartridge 7 is mounted to the drum cartridge 6, the developing cartridge 7 is arranged above the drum cartridge 6. The shaft insertion part 125 and the developing electrode 93 are respectively contacted to the upper end edges of the left sidewall 41 and right sidewall 42 at the fronts of the roller shaft receiving parts 48 of the left sidewall 41 and right sidewall 42. Then, while the developing cartridge 7 is pressed backward and the shaft insertion part 125 and the electrode member are respectively slid on the upper end edges of the left sidewall 41 and right sidewall 42, the developing cartridge 7 is moved backward. When the shaft insertion part 125 and the electrode member are received in the roller shaft receiving parts 48, the front end portion of the developing cartridge 7 is pressed down toward the bottom wall 45 of the drum frame 8. Thereby, the mounting of the developing cartridge 7 to the drum cartridge 6 is completed.

Incidentally, under state in which the developing cartridge 7 is mounted to the drum, cartridge 6, the back side screw insertion penetration part 105 of the first gear cover 101 is contacted to the left end portion of the upper side wall 46 of the drum frame 8 from the front.

As described above, both end portions of the developing roller shaft 83 of the developing roller 18 are rotatably inserted into the left sidewall 73 and right sidewall 74 of the housing 13 of the developing cartridge 7, respectively. The developing gear 84 is fixed to the developing roller shaft 83 at the outside of the left sidewall 73. In addition, the input gear 110 that transmits the driving force to the developing gear 84 is arranged at the outside of the left sidewall 73. The first gear cover 101 and the second gear cover 121 are side by side attached to the left sidewall 73. The input gear 110 and the developing gear 84 are individually covered in the axis line direction by the first gear cover 101 and the second gear cover 121, respectively.

Accordingly, when attaching and detaching the developing roller 18 to and from the housing 13, the second gear cover 121 is separated and the first gear cover 101 is not necessarily separated. Accordingly, when attaching and detaching the developing roller 18 to and from the housing 13, a user can perform the attaching and detaching operation freely and easily because it is not necessary to pay attention to the detachment of the input gear 110. As a result, it is possible to reduce the troublesome operation of attaching and detaching the developing roller 18 to and from the housing 13.

The outer side face of the second gear cover 121 is formed at the right side regarding the outer side face of the first gear cover 101. Thereby, it is possible to secure a protrusion amount of the shaft insertion part 125 regarding the outer side face of the second gear cover 121 without enlarging a size of the left-right direction of the developing cartridge 7 (it is possible to increase the protrusion amount of the shaft insertion part 125 as an offset amount between the outer side face of the second gear cover 121 and the outer side face of the first gear cover 101). Therefore, it is possible to improve the operability when mounting the developing cartridge 7 to the drum cartridge 6.

In addition, the housing 13 is formed with the opening 72, which exposes a part of the circumferential surface of the developing roller 18, between the left sidewall 73 and the right sidewall 74. The second gear cover 121 has the toner accommodating part 124. The toner accommodating part 124 extends rightward from the outer side of the left sidewall 73 and is opposed to the opening 72. Thereby, even when toner is leaked from the housing 13 through the opening 72, it is possible to receive the leaked toner with the toner accommodating part 124. Accordingly, it is possible to prevent toner from dispersing to the outside.

Also, the circumferential surface of the developing roller shaft 83 is formed with the cover fixing recess 92 over the circumferential direction thereof. The second gear cover 121 is formed with the engagement claws 126. The engagement claws 126 enter the cover fixing recess 92, so that it is possible to position the second gear cover 121 in the left-right direction conforming to the developing roller shaft 83.

The bosses 95 protrude leftward from the left sidewall 73 of the housing 13. The second gear cover 121 is formed with the boss insertion holes 127. The developing roller shaft 83 is inserted into the shaft insertion part 125 and the bosses 95 are inserted into the boss insertion holes 127, so that it is possible to position the second gear cover 121 in a rotational direction having the developing roller shaft 83 as a center.

Furthermore, the boss insertion hole 127 is formed at the front side of the inner surface thereof with the projection 128. Accordingly, when the developing roller 18 is rotated in a counterclockwise direction of FIG. 8, the projection 128 contacts the boss 95 from the upstream side of the rotational direction of the developing roller 18. The opening area of the boss insertion opening 127 is larger than the sectional area of the boss 95, and there is a gap between the boss 95 and the inner surface of the boss insertion opening 127 at the state in which the boss 95 is inserted into the boss insertion opening 127. However, the projection 128 contacts the boss 95, so that it is possible to remove the rattling of the boss 95 due to the gap.

In addition, the bosses 95 are provided above and below the first shaft insertion through-hole 79. Therefore, as the developing roller 18 is rotated, even when the developing roller shaft 83 is applied with force acting backward (force of a direction deviating from the first shaft insertion through-hole 79) and the upper and lower parts of the first shaft insertion through-hole 79 of the left sidewall 73 are thus pushed by the developing roller shaft 83, it is possible to prevent the upper and lower parts of the shaft insertion through-hole 79 of the left sidewall 73 from being vertically opened.

Also, the first gear cover 101 is formed with the back side screw insertion penetration part 105 that is opposed to the second gear cover 121 from the upper part. The first gear cover 101 is attached to the housing 13 by the screw 108 that is inserted into the back side screw insertion penetration part 105. Under state in which the developing cartridge 7 is mounted to the drum cartridge 6, the back side screw insertion penetration part 105 of the first gear cover 101 rigidly fixed to the housing 13 is contacted to the drum frame 8. Accordingly, under state in which the developing cartridge 7 is mounted to the drum cartridge 6, it is possible to make the back side screw insertion penetration part 105 contact the drum frame 8 stably.

Furthermore, the head of the screw 108 is arranged at the right side regarding the outer side face of the second gear cover 121. Therefore, when the developing cartridge 7 is mounted to the drum cartridge 6, it is possible to prevent the head of the screw 108 from being caught at the drum cartridge 6 (drum frame 8). Thus, it is possible to secure the smooth mounting of the developing cartridge 7 to the drum cartridge 6.

In addition, regarding the second gear cover 121, the corner part formed by the main body part 122 and the upper extension 123 and the corner part formed by the main body part 122 and the toner accommodating part 124 are chamfered. Therefore, when the developing cartridge 7 is mounted to the drum cartridge 6, it is possible to prevent the corner parts from being caught at the drum cartridge 6 (drum frame 8). Thus, it is possible to secure the smoother mounting of the developing cartridge 7 to the drum cartridge 6.

What is claimed is:

1. A developing cartridge comprising:

a developing roller having a developing roller shaft;

a housing comprising a first sidewall through which a first end portion of the developing roller shaft is rotatably inserted along an axis line direction thereof and a second sidewall through which a second end portion of the developing roller shaft is rotatably inserted along an axis line direction thereof;

a developing gear, which is arranged outside of the first sidewall, and which is fixed to the first end portion of the developing roller shaft at the first sidewall;

a transmission gear, which is arranged outside of the first sidewall, and which is configured to transmit driving force to the developing gear;

a first cover member, which is attached to the first sidewall, and which covers the transmission gear from an outer side in the axis line direction; and a second cover member, which is configured to be removably attached to the first sidewall from the outer side of the first cover member, and which covers at least a part of the developing gear from the outer side in the axis line direction and through which the first end portion of the developing roller shaft is inserted, wherein the second cover member is formed separately from the first cover member and is arranged side by side with the first cover member outside of the first sidewall.

2. The developing cartridge according to claim 1, wherein an outer side face of the second cover member in the axis line direction is formed inward of an outer side face of the first cover member in the axis line direction of the first cover member.

3. The developing cartridge according to claim 1, wherein the housing is formed with an opening between the first sidewall and the second sidewall, which exposes a part of a circumferential surface of the developing roller, and wherein the second cover member integrally comprises a developer accommodating part, which extends toward the second sidewall from outside of the first sidewall, and which is opposed to the opening so as to prevent developer from being leaked from the opening.

4. The developing cartridge according to claim 1, wherein a circumferential surface of the developing roller shaft is formed with a recess over a circumferential direction thereof, and wherein the second cover member integrally comprises an engagement part that fits into the recess and is engaged in the axis line direction.

5. The developing cartridge according to claim 1, wherein the first sidewall is provided with a boss that protrudes into the outside regarding the axis line direction, and wherein the second cover member comprises a boss insertion hole into which the boss is inserted.

6. The developing cartridge according to claim 5, wherein an inner face of the boss insertion hole comprises a projection that contacts the boss from an upstream side of a rotational direction of the developing roller.

7. The developing cartridge according to claim 5, wherein the boss is respectively provided to both sides that sandwich a part of the first sidewall through which the developing roller shaft is inserted.

8. The developing cartridge according to claim 1, wherein the developing cartridge is mounted to a drum cartridge holding a photosensitive drum by moving the developing cartridge in a mounting direction orthogonal to the axis line direction, wherein the first cover member comprises a contact part, which is opposed to the second cover member in the axis line direction and a direction orthogonal to the mounting direction, and which contacts the drum cartridge during mounting the developing cartridge to the drum cartridge, and wherein the contact part is fixed to the first sidewall, so that the first cover member is attached to the first sidewall.

9. The developing cartridge according to claim 8, further comprising a screw that penetrates the contact part and whose leading end is screw-engaged to the first sidewall to fix the contact part to the first sidewall, and wherein a head of the screw is arranged at an inner side of an outer side face of the second cover member with respect to the axis line direction of the second cover member.

10. The developing cartridge according to claim 8, wherein a corner part, which is formed by the outer side face of 10 the second cover member with respect to the axis line direction and a section of the second cover member at a downstream side of the mounting direction, is chamfered.

11. The developing cartridge according to claim 8, wherein a corner part, which is formed by a section of the second cover member at a downstream side of the mounting direction and a section of the second cover at an opposite side to the contact part, is chamfered.

12. The developing cartridge according to claim 1, wherein the first end portion of the developing roller shaft is configured to be inserted through the second cover member with an interval formed between the first end portion and the second cover member.

13. A developing cartridge comprising:

a developing roller having a developing roller shaft;

a housing comprising a first sidewall through which a first end portion of the developing roller shaft is rotatably inserted along an axis line direction thereof and a second sidewall through which a second end portion of the developing roller shaft is rotatably inserted along an axis line direction thereof;

a developing gear, which is arranged outside of the first sidewall, and which is fixed to the first end portion of the developing roller shaft at the first sidewall;

a transmission gear, which is arranged outside of the first sidewall, and which is configured to transmit driving force to the developing gear;

a first cover member, which is attached to the first sidewall, and which covers at least a part of the transmission gear from an outer side in the axis line direction; and a second cover member, which is attached to the first sidewall, and which covers the developing gear from the outer side in the axis line direction and through which the first end portion of the developing roller shaft is inserted, wherein the second cover member is formed separately from the first cover member and is arranged side by side with the first cover member outside of the first sidewall, and wherein the second cover member comprises:

a main body part having a substantially rectangular shape, when seen from a side face, the substantially rectangular shape extending lengthwise orthogonal to the axis-line direction, wherein a central portion of the main body part has a shaft insertion part, which protrudes outward from the main body part, and which includes a hollow portion that allows the inner and outer sides of the main body part to communicate, wherein the shaft insertion part has a plurality of protruding engagement parts, each having a triangular section, and wherein the main body part also has a pair of boss insertion holes passing through the main body part, each boss insertion hole have a substantially square shape, and the pair of boss insertion holes being respectively formed above and below the shaft insertion part;

an upper extension having a rectangular plate shape and extending inward from an upper part of a rear end of the main body part; and a toner accommodating part having an L-shaped section and extending inward from a lower part of the rear end edge and a lower end edge of the main body part, wherein a corner part formed by the main body part and the upper extension is chamfered, wherein a corner part formed by the main body part and the toner accommodating part is chamfered.

14. The developing cartridge according to claim 13, wherein the first end portion of the developing roller shaft is configured to be inserted through the second cover member with an interval formed between the first end portion and the second cover member.

* * * * *